US010876251B2

(12) United States Patent
Van Rooij

(10) Patent No.: US 10,876,251 B2
(45) Date of Patent: Dec. 29, 2020

(54) COMPOSITION OF ARTIFICIAL HAIR AND PRODUCTION METHOD THEREOF

(71) Applicant: GOODWELL SINO TRADING LIMITED, Wanchai (HK)

(72) Inventor: Reinhart Cornelis Van Rooij, Mezares (LV)

(73) Assignee: Goodwell Sino Trading Limited, Wanchai (HK)

( * ) Notice: Subject to any disclaimer, the term of this patent is extended or adjusted under 35 U.S.C. 154(b) by 1134 days.

(21) Appl. No.: 14/777,941

(22) PCT Filed: Mar. 11, 2014

(86) PCT No.: PCT/IB2014/000280
§ 371 (c)(1),
(2) Date: Sep. 17, 2015

(87) PCT Pub. No.: WO2014/147459
PCT Pub. Date: Sep. 25, 2014

(65) Prior Publication Data

US 2016/0348306 A1 Dec. 1, 2016

(30) Foreign Application Priority Data

Mar. 20, 2013 (BE) ..... 2013/0189
Jan. 15, 2014 (BE) ..... 2014/0024

(51) Int. Cl.
*D06M 15/17* (2006.01)
*A63H 3/44* (2006.01)
(Continued)

(52) U.S. Cl.
CPC ..... *D06M 15/17* (2013.01); *A41G 3/0083* (2013.01); *A63H 3/44* (2013.01); *D06M 13/11* (2013.01);
(Continued)

(58) Field of Classification Search
CPC ..... A41G 3/0083; A63H 3/44; D06M 15/15; D06M 13/11; D06M 13/53; D06M 15/71; D06M 13/23; D06M 13/395
See application file for complete search history.

(56) References Cited

U.S. PATENT DOCUMENTS 1,921,363 A 8/1933 Lefranc
2002/0187173 A1* 12/2002 L'Alloret ..... A61K 8/8147 424/401
(Continued)

FOREIGN PATENT DOCUMENTS

JP 2004137654 A 5/2004
JP 2008231652 A 10/2008
(Continued)

OTHER PUBLICATIONS

International Application No. PCT/IB2014/000280, International Search Report dated May 26, 2014.

*Primary Examiner* — Jennifer A Chriss
*Assistant Examiner* — Ricardo E Lopez
(74) *Attorney, Agent, or Firm* — Dinsmore & Shohl LLP

(57) ABSTRACT

Composition and production methods of artificial hair (11) with natural organic material, comprising a core (12), surrounded by a mantle (9), whereby the core comprises a strong fiber with one or more filaments (13) and whereby the mantle comprises one or more layers of shellac and liquefied hydrolysed human hair, combined with crosslinkers that are attached to the core that can be composed of natural fibroin fibers or of fibers of a high performance synthetic polymer.

11 Claims, 2 Drawing Sheets

Figure 1:
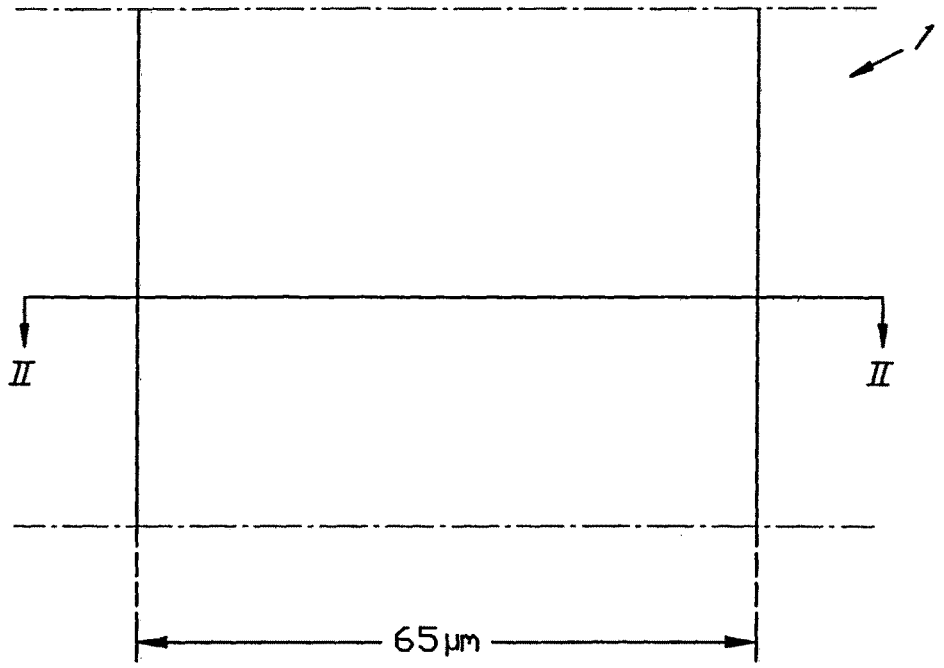

(51) Int. Cl.

| | |
|---|---|
| ***D06M 15/15*** | (2006.01) |
| ***D06M 13/395*** | (2006.01) |
| ***D06M 13/53*** | (2006.01) |
| ***D06M 15/71*** | (2006.01) |
| ***A41G 3/00*** | (2006.01) |
| ***D06M 13/11*** | (2006.01) |
| ***D06M 13/207*** | (2006.01) |
| ***D06M 13/123*** | (2006.01) |
| *D06M 101/12* | (2006.01) |
| *D06M 101/16* | (2006.01) |

(52) U.S. Cl.

CPC ..... *D06M 13/123* (2013.01); *D06M 13/207* (2013.01); *D06M 13/395* (2013.01); *D06M 13/53* (2013.01); *D06M 15/15* (2013.01); *D06M 15/71* (2013.01); *D06M 2101/12* (2013.01); *D06M 2101/16* (2013.01); *D06M 2200/12* (2013.01); *D06M 2400/01* (2013.01)

(56) References Cited

U.S. PATENT DOCUMENTS

| | | | | |
|---|---|---|---|---|
| 2005/0282702 | A1 | 12/2005 | Murasawa et al. | |
| 2009/0217938 | A1* | 9/2009 | Rabe | A41G 5/02 132/216 |
| 2012/0055499 | A1* | 3/2012 | Sanbonmatsu | A41G 5/02 132/201 |
| 2012/0247497 | A1* | 10/2012 | Zhang | C09J 4/00 132/201 |
| 2014/0328785 | A1* | 11/2014 | Ilekti | A61K 8/31 424/70.7 |

FOREIGN PATENT DOCUMENTS

| | | | | |
|---|---|---|---|---|
| WO | 2008114135 | A1 | 9/2008 | |
| WO | WO-2013087426 | A1 * | 6/2013 | A61K 8/31 |

* cited by examiner

COMPOSITION OF ARTIFICIAL HAIR AND PRODUCTION METHOD THEREOF

CROSS-REFERENCE TO RELATED APPLICATIONS

This application is the U.S. National Phase of PCT/IB2014/000280 filed Mar. 11, 2014, which claims priority of Belgian Patent Application 2013/0189 filed Mar. 20, 2013, and Belgian Patent Application 2014/0024 filed Jan. 15, 2014.

The present invention relates to a composition of an artificial hair strand and a production method for the manufacturing thereof.

More specifically, the invention is intended for the manufacturing of artificial hair in order to replace or supplement human hair, or to manufacture wigs intended for human use or for use on mannequins or dolls.

It is known that artificial hair is used for the manufacturing of wigs or hairpieces that are used to provide more hair for people with a lack of head hair.

Traditionally, artificial fibers of one or more polymer fibers are used for this purpose, that are given the desired colour by means of dyes.

A problem with such artificial hair is that it does not behave like human hair and therefore it cannot entirely fulfil its role as a hair replacement.

Artificial hair fibers of plastic do not present the characteristics of natural human hair such as 100% ash formation, the organic odour after combustion, the colourability and bleachability, the curlability, etc.

The lifespan of plastic artificial hair fibers is unsatisfactory as well as their heat resistance such as their resistance to boiling water in which artificial hair often loses its curls, and such as in their resistance to thermocurling or -straightening device, by which artificial hair fibers are often irreversibly damaged.

The purpose of the present invention is to provide a solution to the aforementioned and other disadvantages by providing a first in part natural, organic and man-made imitation hair, whose composition is obtained by a production method that also forms part of this invention.

The present invention concerns a composition of artificial hair with natural organic material, comprising a core, surrounded by a mantle, whereby the core comprises a strong fiber with one or more filaments and whereby the mantle comprises one or more layers of shellac and liquefied hydrolysed human hair, combined with crosslinkers.

An advantage attached to such a composition is that the natural shellac is chemically modified by cross-linking, such that the characteristics of the shellac are improved and the material is much more heat resistant and stronger.

Shellac is a thin varnish obtained from a natural resin from an insect *Laccifera lacca* that is harmless to humans and is dissolved in alcohol. It is neutral to acidic and is as a rule soluble in alcohol.

Liquefied hydrolysed human hair is comparable to viscose and is therefore dilutable in water. This makes the combination of liquefied human hair with shellac difficult and more particularly the making of intermolecular bonds between them.

This invention solves this problem by first of all making the shellac fraction basic and adding the shellac to the hydrolysed human hair, liquefied in a basic solution, whereafter lactic acid is added to return to a neutral or acidic condition. Thereafter crosslinkers, such as viscose or other chemical crosslinkers, can be added so as to enable intermolecular bonds between shellac and hydrolysed human hair whereby both components are integrated.

This invention discloses that it is possible to chemically crosslink shellac which renders it surprisingly thermally resistant up to 200° C., whereas natural shellac melts already at 80° C., and moreover that it is possible to bind this polymer to keratine through ionic bonds partly obtained by a corona- or a plasma-treatment.

Preferably the crosslinker comprises epichlorohydrin or glutaraldehyde combined with polyisocyanate and/or hydrophilic aliphatic polyisocyanate to crosslink liquefied hydrolysed human hair and other components in the layer or layers of the mantle.

The crosslinker in the epoxy-gluelayer also has a binding effect on part of the natural organic matter in the shellac- and keratine layer or -layers.

Preferably viscose and also lactic acid are added to the mantle layer, which improves the hardness and strength of the mantle. Lactic acid contains hydroxyl- and carboxyl-groups that enhance intermolecular bonds and viscose works as a crosslinker.

In a first embodiment of the invention the core is composed of natural fibroin fibers such as silk. The diameter of the natural fibroin core measures from 30 μm to 50 μm.

An advantage of natural fibroin fibers is that they are strong and resistant to mechanical loads.

The present invention also concerns a production method for artificial hair with a core of natural fibroin fibers whereby multi-filament fibers of natural fibroin are impregnated in a shellac solution with chemically reactive ingredients to which mantle constituents are then attached in a number of coating and wetting stations that comprise different crosslinkers and couplers for the mantle constituents and for the shellac.

One natural fibroin mono-filament fiber measures approximately 3 detex (detex=mass in grams/10,000 m), ten fibroin mono-filaments measure between 30 and 33 detex after impregnation and coating, or between 50 and 60 μm diameter when manually measured or electron-microscopically measured.

A mass/length between 37 and 39 detex is measured after impregnation and coating between 70 μm and 80 μm.

A mass/length between 40 and 44 detex is measured after impregnation and coating between 75 μm and 90 μm.

The most preferable embodiment of the production method for the manufacture of artificial hair with a core of natural fibroin fibers is described in the following steps:

In a first step an impregnating liquid with chemically reactive ingredients is dissolved in a shellac solution, resulting in the following composition:

- 20% shellac in alcohol as a solvent;
- 5% trifunctional adhesion promoter, glycerol polyglycidyl ether;
- 5% bifunctional hydrogenated bisphenol-A-diglycidyl ether to obtain weather resistance;
- 0.1% telomere B monoether with polyethylene glycol to even out the artificial hair;
- 5% high density cross-linker, ethylene glycol diglycidyl ether;

with or without solvent pigments.

In a second step untreated fibroin multifilaments are chosen with a detex between 30 and 44 (detex=mass in grams/10,000 metres).

The fibroin monofilaments are preferably firmly wound on a cone in order to form multifilaments. The cone is placed in a cylindrical pot in a small cage from which the fibers are drawn.

In a third step the aforementioned impregnating liquid is poured in the aforementioned cylindrical pot and the cone with fibroin remains in this liquid during the production process. The fiber is drawn from the impregnating liquid and the cone by a strand winder that draws the fiber through a coating machine that comprises five coating and wetting stations and six drying zones, each approximately 10 metres long.

The drying zones make use of shortwave infrared (IR) radiation. The temperature is 180° C. to 260° C., and preferably 240° C., and the drawing speed is 3 metres per second.

In this step the fiber is drawn through the following five coating and wetting stations:

1—A first station that contains 25% hydrolysed and liquefied human hair in water.

2—A second station that contains 15% shellac dissolved in alcohol, 5% bifunctional hydrogenated bisphenol A ethylene ether, 5% high density cross-linker ethylene glycol diglycidyl ether, and 0.1% telomere B monoether with polyethylene glycol.

3—A third station that contains isocyanides 2-4% in alcohol, 0.1% telomere B monoether with polyethylene glycol as a cross-linker for shellac.

4—A fourth station that contains 15% shellac, 2.5% trifunctional adhesion promoter glycerol-polyglycidyl ether, 2.5% bifunctional hydrogenated bisphenol-A-diglycidyl ether, 0.1% telomere-B-monoether with polyethylene glycol and 2.5% high density cross-linker ethylene glycol-diglycidyl ether.

5—A fifth station that contains 20% lactic acid in ethyl acetate containing 7% 2-mercaptoethanol, 7% epichlorohydrin cross-linkers for the keratin of human hair, 2% unrefined lanolin as a natural fat, 2% silicones and 0.1% telomere-B-monoether with polyethylene-glycol.

In a fourth step the fibers are rewound on a spool at the end of the production line, and they are removed from the spool again in order to be dried under tension in a hot-air oven at a temperature of 140° C. for 1 hour.

The tension is then relaxed, after which the fibers are placed loosely in a hot air oven for further cross-linking with a drying time of 30 minutes.

In a fifth step the fibers are placed in an oven at 50° C. for 24 hours, after which the fibers are taken out of the oven for further processing.

The temperature of the liquids preferably remains below the evaporation point or flashpoint.

The artificial hair with a core of natural fibroin obtained, offers the following advantages:

- the hair fiber can be coloured with alkaline peroxide dyes and/or with solvent pigments after production;
- the hair fiber reacts with a chemical perming solution and neutraliser;
- the hair fiber is resistant to solvents;
- the hair fiber is resistant to a temperature of 200° C. over a short cycle and 140° C. over a long cycle;
- the feel of the hair fiber is similar to human hair of the same thickness;
- the hair fiber is resistant to boiling water over a short cycle of 25 seconds, but becomes slightly irregular upon longer exposure and then has to be treated with straightening tongs;
- the hair fiber is resistant to the water temperature of a hot shower;
- the hair fiber absorbs less water than most human hair;
- when manufactured with or without flame retardants depending on the desired flame retardation, the hair fiber always burns in a similar way to human hair, i.e. with 100% ash formation and an organic odour, and first with black smoke and then white smoke when there is no flame retardant, and with a greyish smoke upon short combustion when flame retardant is present, just as with human hair;
- the hair fiber is resistant to hot curling tongs;
- the hair fiber preserves its thermal waves or thermal curls upon exposure to cold and tepid/warm water;
- the hair fiber cannot be detected as not 100% human without special tests or equipment;
- the hair fiber is ideal for mixing with human hair in a ratio of 25, 50 or 75% in order to achieve a combustion odour or an improved odour such as with human hair;
- the hair fiber behaves similarly to processed human hair;
- the hair fiber can be cut with scissors or a knife just like human hair;
- the hair fiber is just as resistant to repeated curling as human hair;
- furthermore the hair fiber is resistant to repeated straightening with curling tongs;
- the hair fiber looks, feels and smells like human hair.

These characteristics ensure that the artificial hair is a fully-fledged replacement for human hair and can be treated in practically the same way.

In a second embodiment of the invention the core is composed of a high performance synthetic polymer. The high performance synthetic polymer is chosen from the group of the following polymers:

| | | | |
|---|---|---|---|
| polysulfon | PTFE | PEEK-GF | PPA |
| polysufur | Tehnora | PEEK-CA | PBT |
| PEEK | TPX | PESU | PEN |
| polyethersulfon | Victrex PEEK | PEI | PEEK-BG |
| polyimide | ICE | POM | PAI |
| LCP; | | | |

and preferably not of the group of the following lower performing polymers:

| | | |
|---|---|---|
| PET | PES | PETP |
| nylons | PVC | polyolefines. |

The diameter of the synthetic polymer core measures from 50 μm to 70 μm. The mantle around the core of synthetic polymers comprises the crosslinkable components liquefied hydrolysed human hair or keratine and shellac, lactic acid and chemical crosslinkers, and is bound to the core by means of a glue layer. Preferably the glue layer comprises an epoxy glue.

Optionally 0.2% to 1% of cubical boron nitride or CBN is added to the core in nano-particles smaller or equal to 3 μm in case of a mono-filament core or in nano-powder particles smaller than 1 μm in case of a multi-filament core.

The advantage of the boron nitride shine reducer is that it is not subject to oxidation, as is the case for the usual $TiO_2$ particles (0.1% to 2%) that degrade and damage the polymer over the years.

Alternatively 2% to 20% of ultrafine ground glass fiber or cubical boron nitride is added to the core polymer, whereby the particle size is 3 μm or less in case of a mono-filament core and is 1 μm or less in case of a multi-filament core.

Although ultrafine ground glass powder is not safe for the human body, this glass powder is safe since the particles are completely embedded by a strong ionic bond between the polymers and the glass particles, such that the glass particles do not detach or fragment further. The bond between glass and polymer is enhanced by a corona treatment of the high performance polymer, such that it becomes safe for human use.

An advantage of adding glass powder is that the stretchability of the hairstrand is lowered, such that the hairstrand is less damaged by coaming or forceful brushing.

The invention also concerns a production method for artificial hair with a core of a mono- or multifilament fiber of synthetic high performance polymers, followed by one or more coating steps of the core with one or more layers of shellac and liquefied hydrolysed human hair, combined with crosslinkers.

This production method comprises at least the following six steps:

A) in a first step a core fiber of a high performance polymer, optionally strengthened with boron nitride or glass particles, is pulled through a corona and/or plasma treatment unit whereby the polymer chains are partly broken by the corona and/or plasma-radiation and whereby hydroxyl-groups and carboxyl-groups are added, after an exposure period of up to one second long.

B) in a second step the core is coated with a two component epoxy glue immediately after the corona and/or plasma treatment by pulling the fiber preferably in a horizontal way through a bath of glue which is up to ten times diluted with a solvent such as ethylacetate, at a speed of 1 to 5 meter per second, after which the mantle is immediately exposed to heat in order to dry and harden the binding layer.

C) in a third step one or more additional layers are applied, whereby each layer contains:

shellac of 10% to 35%;

liquid hydrolysed human hair of 10% to 35%;

crosslinkers comprising epichlorohydrine or glutaraldehyde combined with polyisocyanate and/or hydrophilic aliphatic polyisocyanate;

optionally viscose and lactic acid as additional fixers; and whereby this coating can be repeated two to three times.

D) in a fourth step a finishing layer or top layer is applied by means of a coam polymer with a spine with branches on one side to obtain an additional and enduring gliding effect.

E) in a fifth step the core and the mantle are additionally subjected to a corona and/or plasma shock treatment after the finishing, during up to one second, before being dried in an oven, being hardened and crosslinked further.

F) in a sixth step the product is dried in a hot-air oven at 90° C. to 180° C. during 5 minutes up to 24 hours, depending on the type of polymer in the core and on the thickness of the applied mantle, whereby the artificial hairstrand is bound and crosslinked further.

The artificial hair obtained with a core of high performance synthetic polymer offers the following advantages:

where Asian bleached and dyed natural hair is damaged by lengthy drying at a high temperature and by chemical products and starts to look like straw, this artificial hair is resistant to this and keeps its properties at higher temperatures and after chemical treatments such as bleaching with peroxide or treatments with strong acids or strong bases. Where natural hair loses its thermally induced curls in tepid water, this artificial hair keeps its thermally induced curls even in boiling water depending on the type of high performance polymer (HPP) used.

this artificial hair is stronger and offers a much longer lifespan than other known hair strands with or without natural or synthetic organic materials. The strength obtained is at least 15% higher than a human hair of the same diameter.

this artificial hair forms ashes upon burning and gives an organic or partly organic odour when wet that is comparable to the smell of wet human hair. Dyes and moisture are taken up better than in the known types of artificial hair.

Figure 2:
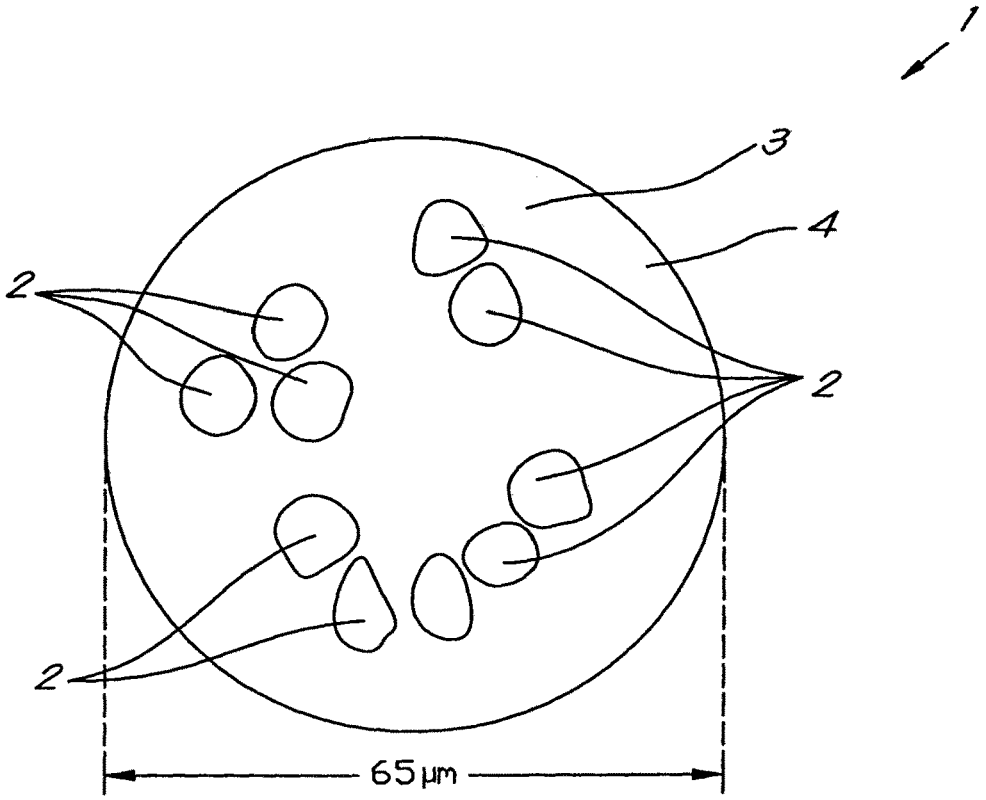
Figure 3:
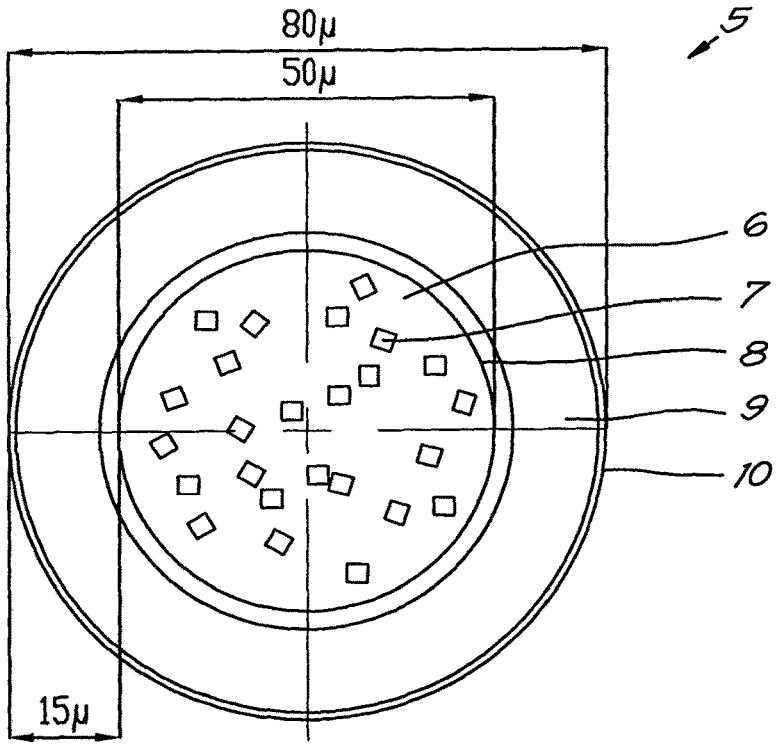
Figure 4:
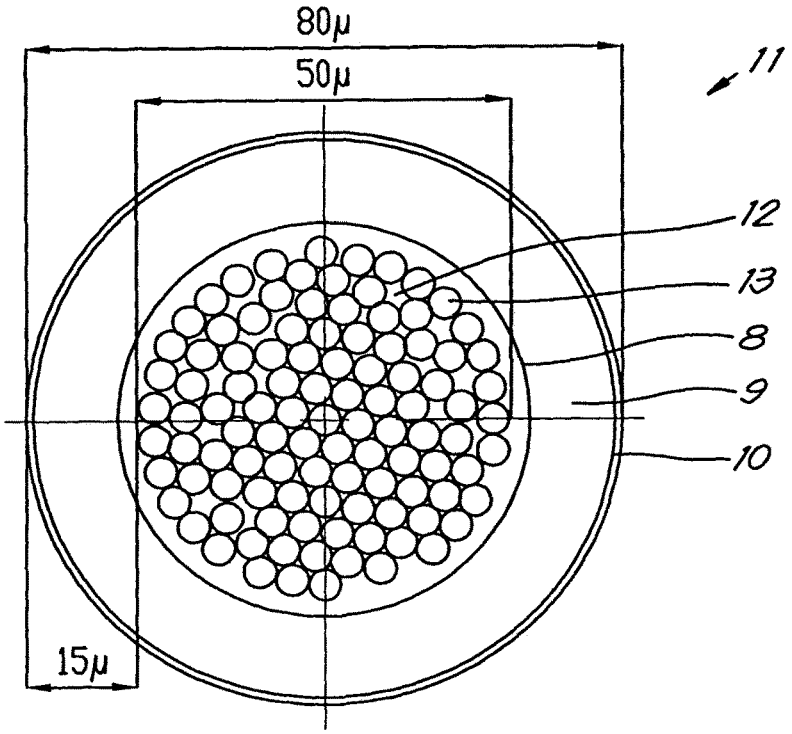

With the intention of better showing the characteristics of the invention, preferred embodiments of artificial hair according to the invention are described hereinafter by way of an example, without any limiting nature, with reference to the accompanying drawings, wherein:

FIG. 1 schematically shows a top view of one artificial hair with a core of natural fibroin fiber according to the invention;

FIG. 2 shows a cross-section according to line II-II of FIG. 1 perpendicular to the longitudinal direction of the artificial hair;

FIG. 3 schematically shows a cross-section of an artificial hair with a mono-filament core of a high performance polymer according to the invention;

FIG. 4 schematically shows a cross-section of a variant of FIG. 3 with a multi-filament core of a high performance polymer.

FIG. 1 schematically shows a top view of one artificial hair 1 with a core of natural fibroin fiber, that demonstrates its constant diameter, in this case 65 μm.

FIG. 2 schematically shows an electron microscope image of a cross-section of the artificial hair 1 of FIG. 1, on which in this case ten constituent fibroin fiber filaments can be seen in the core, surrounded by a cross-linked matrix 3 in which recross-linked, hydrolysed and liquefied human hair 4 is present, and whereby the diameter of the artificial hair is 65 μm in this case.

FIG. 3 schematically shows a cross-section perpendicular to the lengthwise direction of one artificial hair 5 with a core 6 of a high performance polymer according to the invention, showing its hair fiber diameter of 80 μm. The artificial hair 5 comprises a mono-filament core 6 with a diameter of 50 μm, in which boron nitride particles 7 of three μm are taken up. The core 6 is surrounded by a layer of epoxy-glue 8 that ensures the bonding between the core 6 and the surrounding mantle 9 of natural organic material that has a thickness of 15 μm. The surrounding mantle 9 is finished with a finish layer 10 with a coam polymer that provides good gliding properties of the hair.

FIG. 4 schematically shows a cross-section of a variant 11 of a single artificial hair of FIG. 3, whereby in this case the core of high performance polymer is a multi-filament core 12 comprising several filaments 13 of a high performance polymer, around which in this case a concentric mantle 9 of natural organic material is represented that is bound by means of an expoxy-glue 8 to the core 12, and is finished by means of a finish layer 10 with a coam polymer on the outside.

The use of the artificial hair is very simple and as follows.

The artificial hair can be used in hair extensions and as weft in long-haired wigs in order to change or improve hairstyle or to lengthen their hair.

The use of the artificial hair is no different to natural human hair, because the artificial hair is resistant to the usual operations that are applied to human hair.

For example, the artificial hair is resistant to and/or compliant with washing, hot showers, thermal waving or thermal curling, cutting and perming, colouring, bleaching, combing and treatment with hair-care products.

The present invention is by no means limited to the embodiments described as an example and shown in the drawings, but an artificial hair according to the invention can be realised in all kinds of variants, without departing from the scope of the invention as defined in the claims.

The invention claimed is:

1. Composition of artificial hair with natural organic material, comprising a core, surrounded by a mantle, whereby the core comprises a strong fiber with one or more filaments, and whereby the mantle comprises one or more layers of shellac and liquefied hydrolysed human hair, combined with crosslinkers that are attached to the core, wherein the mantle is bound to the core by an epoxy glue layer.

2. Composition of artificial hair according to claim 1, characterized in that the core is composed of natural fibroin fibers.

3. Composition of artificial hair according to claim 2, characterized in that the core is composed of silk.

4. Composition of artificial hair according to claim 1, characterized in that the core is composed of a high performance synthetic polymer.

5. Composition of artificial hair according to claim 4, characterized in that the high performance synthetic polymer is chosen from the group of the following polymers:

polysulphone, polytetrafluorethylene, polyether ether ketone, polyphthalamide-polysulphide, long-chain synthetic polyamide in which at least 85% of the amide linkages, (—CO—NH—) are attached directly to two aromatic rings, polybutyleneterephthalate, metylpentene copolymer, polyethersulphone, polyethylenenaphthalate, polyethyleneimine, polyimide, polyoxymethylene, polyamide imide, liquid crystal polymer.

6. Composition of artificial hair according to claim 4, characterized in that the mantle comprises the crosslinkable components liquefied hydrolysed human hair (keratine) and shellac, lactic acid and chemical crosslinkers.

7. Composition of artificial hair according to claim 1, characterized in that the diameter of the core is from 30 μm to 70 μm.

8. Composition of artificial hair according to claim 4, characterized in that 0.2% to 1% of cubical boron nitride or CBN is added to the core in nano-particles smaller or equal to 3 μm in case of a mono-filamentous core or in nano-powder particles smaller than 1 μm in case of a multi-filamentous core.

9. Composition of artificial hair according to claim 4, characterized in that 2% to 20% of ultrafine ground glass fiber or cubical boron nitride is added to the core polymer, whereby the particle size is 3 μm or less in case of a monofilamentous core and is 1 μm or less in case of a multifilamentous core.

10. Composition of artificial haft with natural organic material, comprising a core, surrounded by a mantle, whereby the core comprises a strong fiber with one or more filaments, whereby the mantle comprises one or more layers of shellac and liquefied hydrolysed human hair, combined with crosslinkers that are attached to the core, whereby the core is composed of a high performance synthetic polymer, whereby 0.2% to 1% of cubical boron nitride or CBN is added to the core in nanoparticles smaller or equal to 3 μm in case of a mono-filamentous core or in nano-powder particles smaller than 1 μm in case of a multi-filamentous core.

11. Composition of artificial hair with natural organic material, comprising a core, surrounded by a mantle, whereby the core comprises a strong fiber with one or more filaments, whereby the mantle comprises one or more layers of shellac and liquefied hydrolysed human hair, combined with crosslinkers that are attached to the core, whereby core is composed of a high performance synthetic polymer, whereby 2% to 20% of ultrafine ground glass fiber or cubical boron nitride is added to the core polymer, and whereby the particle size is 3 μm or less in case of a monofilamentous core and is 1 μm or less in case of a multifilamentous core.

* * * * *